US007669672B2

(12) United States Patent
Brunet et al.

(10) Patent No.: US 7,669,672 B2
(45) Date of Patent: Mar. 2, 2010

(54) APPARATUS, SYSTEM AND METHOD FOR INSTALLING BOREHOLES FROM A MAIN WELLBORE

(76) Inventors: Charles Brunet, 1017 Nantucket, Unit D, Houston, TX (US) 77057; Michel Bouchard, 1703-605 13th Avenue, Calgary, Alberta (CA) T2R 0K6

( * ) Notice: Subject to any disclaimer, the term of this patent is extended or adjusted under 35 U.S.C. 154(b) by 89 days.

(21) Appl. No.: 11/585,701

(22) Filed: Oct. 23, 2006

(65) Prior Publication Data

US 2007/0125577 A1 Jun. 7, 2007

Related U.S. Application Data

(60) Provisional application No. 60/742,302, filed on Dec. 6, 2005.

(51) Int. Cl.
*E21B 7/04* (2006.01)
*E21B 7/08* (2006.01)

(52) U.S. Cl. ..... 175/83; 175/62; 166/117.6; 166/237

(58) Field of Classification Search ..... 175/80, 175/83, 61; 166/117.5, 117.6, 313, 237, 166/50, 62

See application file for complete search history.

(56) References Cited

U.S. PATENT DOCUMENTS 3,011,568 A * 12/1961 Grimm ..... 175/74
4,050,512 A * 9/1977 Giebeler ..... 166/128
4,880,067 A * 11/1989 Jelsma ..... 175/107
5,346,017 A * 9/1994 Blount et al. ..... 166/380
5,413,184 A 5/1995 Landers
5,467,819 A * 11/1995 Braddick ..... 166/117.6
5,474,126 A * 12/1995 Lynde et al. ..... 166/117.6
5,667,025 A * 9/1997 Haessly et al. ..... 175/78
5,853,056 A 12/1998 Landers
6,012,516 A * 1/2000 Brunet ..... 166/50
6,056,056 A * 5/2000 Durst et al. ..... 166/298
6,125,949 A 10/2000 Landers
6,142,225 A * 11/2000 McCorry et al. ..... 166/117.6
6,283,230 B1 * 9/2001 Peters ..... 175/67
6,305,474 B1 * 10/2001 Roberts et al. ..... 166/313
6,315,054 B1 * 11/2001 Brunet ..... 166/387
6,554,062 B1 * 4/2003 Dewey et al. ..... 166/50
6,564,871 B1 * 5/2003 Roberts ..... 166/313
6,578,636 B2 * 6/2003 Mazorow et al. ..... 166/298
7,311,157 B1 * 12/2007 Clarke ..... 175/61
2002/0023757 A1 * 2/2002 George et al. ..... 166/380
2002/0070013 A1 * 6/2002 Bond ..... 166/50
2002/0070018 A1 * 6/2002 Buyaert ..... 166/255.3
2002/0175004 A1 * 11/2002 Mazorow et al. ..... 175/78
2003/0010497 A1 * 1/2003 Begg et al. ..... 166/298

* cited by examiner

*Primary Examiner*—Jennifer H Gay
*Assistant Examiner*—Cathleen R Hutchins
(74) *Attorney, Agent, or Firm*—McGarry Bair PC

(57) ABSTRACT

The present application is directed an apparatus for installing boreholes in the formation surrounding a main wellbore, the apparatus comprising an indexing tool comprising an indexing deflector and a deflector shoe; the deflector shoe comprising an opening therethrough configured to receive a borehole forming member; wherein the indexing deflector is configured to direct the deflector shoe from a first setting to at least a second setting for the installation of boreholes at each setting through said opening; to methods employing the apparatus, and methods for using the indexing tool to locate and access boreholes.

46 Claims, 8 Drawing Sheets

APPARATUS, SYSTEM AND METHOD FOR INSTALLING BOREHOLES FROM A MAIN WELLBORE

CROSS-REFERENCE TO RELATED APPLICATIONS

The application is entitled to the benefit of the filing date of the prior-filed provisional application No. 60/742,302, filed on Dec. 6, 2005.

STATEMENT REGARDING FEDERALLY SPONSORED RESEARCH OR DEVELOPMENT

Not applicable.

FIELD OF THE APPLICATION

The application relates generally to an apparatus, system and method for installing boreholes from a main wellbore in drilling operations.

BACKGROUND

During drilling operations it is often necessary to drill one or more additional boreholes out from a main wellbore into the surrounding formation in order to stimulate production and increase the ultimate recovery of reserves. A common technique for installing additional boreholes includes cutting, milling or otherwise drilling holes into the main wellbore casing, followed by installing boreholes into the formation surrounding the main wellbore through the casing holes. Various technologies are currently used to install additional boreholes.

For example, one technology for installing boreholes includes deflecting a drill bit to drill a hole in the well casing using a rotary drill device, and subsequently extending the borehole into the surrounding formation using a known fluid jetting technique.

Another technology includes milling a rectangular slot in the well casing using a rotary drill device, and then using a whipstock to deflect a directional drilling string into the surrounding formation.

Another technology includes drilling a hole in the wellbore casing using a mud motor driven drill device, and subsequently jetting an extended borehole into the surrounding formation.

Another technology includes drilling a hole in the wellbore casing using a rotary drill device and subsequently jetting a relatively short hole into the target formation.

Another technology includes jetting extended articulated or horizontal boreholes into the earth using coil tubing as the conveyance means for high pressure fluid from the surface.

Another technology includes utilizing a mud motor connected by a helical spring to a drill bit to cut a hole in the wellbore casing and extending the hole a short distance into the surrounding formation.

Unfortunately, each of these existing technologies require that the string including the drilling means be removed after a single hole is made in the wellbore casing in order to insert a jetting assembly to jet a borehole through the wellbore casing hole into the surrounding formation. Subsequently, the string including the drilling means must be reinserted to make a second hole in the casing. This requires a significant amount of time for installing multiple boreholes.

Other undesirable characteristics associated with these existing technologies include (1) that the installed boreholes cannot be relocated, re-entered and/or re-accessed for stimulation or for the installation of a liner string after the whipstock is re-oriented to a second position for installing a borehole; (2) that the distance to which the boreholes can be installed may be limited to a short distance in the surrounding formation; (3) that holes cannot be made in the casing at different elevations with any certainty of being able to re-enter or re-access those same holes for jetting boreholes into the surrounding formation; (4) that boreholes cannot be installed at different elevations with any certainty of being able to relocate, re-enter and/or re-access those boreholes at a later date; (5) that the boreholes cannot be installed at different vertical elevations in the same direction in a "stacked" fashion; (6) that known downhole orienting tools cannot be removed from the wellbore and then replaced to the same position and orientation to allow both (a) the previously drilled holes in the wellbore casing and (b) subsequently installed boreholes to be relocated, re-entered and/or re-accessed.

A technology is needed that allows for one or more holes to be made in the wellbore casing prior to the installation of boreholes through the holes into the surrounding formation. A technology is also needed that allows for each casing hole and each borehole extending therefrom to be relocated, re-entered, and/or reaccessed.

SUMMARY

The present application is directed to an apparatus for installing boreholes in the formation surrounding a main wellbore, the apparatus suitably comprising an indexing tool comprising an indexing deflector and a deflector shoe; the deflector shoe suitably comprising an opening therethrough configured to receive a borehole forming member; wherein the indexing deflector is configured to direct the deflector shoe from a first azimuthal setting to at least a second azimuthal setting for the installation of boreholes at each azimuthal setting through said opening; to methods of employing the apparatus; and methods for using the indexing to locate and access boreholes.

According to the invention, an apparatus for installing substantially perpendicular boreholes in a formation surrounding a main wellbore casing having a longitudinal axis comprises an indexing tool comprising a deflector shoe and an indexing deflector wherein the deflector shoe comprises an opening therethrough configured to receive a borehole forming member at a first end of the opening and to direct the borehole forming tool in a substantially perpendicular direction at a second end of the opening for forming a substantially perpendicular borehole in the main wellbore casing with respect to the longitudinal axis and the indexing deflector comprises a fixed member and a moveable member. An actuation member is connected to the movable member to selectively move the movable member from a first position to at least a second position wherein the moveable member is connected to the deflector shoe to direct the deflector shoe from a first azimuthal setting, at which a first substantially perpendicular casing hole and borehole can be made though said opening along a first azimuthal direction, to at least a second azimuthal setting, different than the first azimuthal setting, at which a second substantially perpendicular casing hole and borehole can be made through said opening along a second azimuthal direction as the movable member is moved by the actuation member from the first to the second position, and while the borehole forming tool remains downhole.

The inner member and said outer member can be configured to fastenably rotate about one another during operation of said indexing tool. In one embodiment, the fixed member can be an inner member and said moveable member comprises an outer member configured to encircle said inner member. The outer member can be configured to fastenably rotate about a fixed inner member. Alternatively the inner member can be configured to fastenably rotate within a fixed outer member.

In one embodiment, the indexing tool includes a tubing anchor for releasably securing the indexing tool in a predetermined location within the main wellbore casing and is connected to the fixed member. The indexing tool is configured to move between the first and second azimuthal settings without releasing the tubing anchor.

In another embodiment, the indexing tool is configured so that the first and second substantially perpendicular boreholes are free from overlapping portions. The first and second azimuthal settings can be on a common transverse plane along the longitudinal axis of the main wellbore casing. Alternatively, the first and second azimuthal settings can be on different transverse planes along the longitudinal axis of the main wellbore casing.

In another embodiment, the indexing deflector is releasably secured to the main wellbore casing at a first end and releasably secured to the deflector shoe at a second end. In addition, the indexing deflector can be releasably secured to the main wellbore casing through a tubing anchor. The deflector shoe can be releasably secured to a working string at a second end.

In another embodiment, the diameter of each substantially perpendicular borehole is relatively small compared with the diameter of the main wellbore casing. In a preferred embodiment, the diameter of each substantially perpendicular borehole is in the range of 0.5-1.5 inches (1.27-3.75 cm).

The inner member can include at least one slot that runs along the outer periphery of said inner member and the slot can include one or more landings and the slot can be a seamless configuration. In addition, the slot can have one or more profiles wherein each profile includes a landing. In addition, the slot can have a helical type pattern. In addition, the profiles can be repeatable, non-repeatable or a combination of repeatable and non-repeatable profiles. In addition, the profiles can include J-slot profiles. In addition, each profile can have a landing that correlates to a separate azimuthal setting of the deflector shoe for installing substantially perpendicular boreholes into the formation surrounding the main wellbore casing. The outer member can include at least one pin extending out from the inside wall of said outer member and the pin is configured to mate with the slot which can guide the pin for travel a distance greater than 90° about the periphery of said inner member. In one embodiment, the slot can be configured to guide the pin for travel a distance at least 360° along said slot about said inner member or less than 360° about the periphery of said inner member. In addition, the slot can be configured to guide the pin for travel more than one revolution about said inner member.

Further according to the invention, a system for installing substantially perpendicular boreholes in the formation surrounding a main wellbore having a casing with a longitudinal axis comprises a working string supported on the surface at the upper end of said main wellbore; an indexing tool releasably attached to said working string and comprising an indexing deflector having an inner member with at least one slot that runs along the outer periphery of said inner member, and an outer member that encircles said inner member, said inner member and said outer member being configured to fastenably rotate about one another during operation. and a deflector shoe. The indexing deflector is configured to move the deflector shoe from a first azimuthal setting to at least a second azimuthal setting for the installation of substantially perpendicular boreholes at each azimuthal setting through said opening in response to vertical manipulation of the deflector shoe. Further, a tubing anchor is releasably attached to the indexing tool and configured to lock at least part of said indexing tool at a predetermined depth within said main wellbore during operation of said indexing tool. The indexing tool includes an opening therethrough configured to (a) receive a borehole forming member from the working string, and (b) act as a guide path for said borehole forming member through said opening to install substantially perpendicular casing holes and substantially perpendicular boreholes in the formation surrounding the main wellbore with respect to the longitudinal axis. The indexing tool is configured to mechanically move from a first setting to at least a second setting for the installation of substantially perpendicular boreholes with respect to the longitudinal axis of the main wellbore at each setting through said opening while the borehole forming member remains downhole in response to vertical manipulation by the working string. In addition, the slot comprises one or more profiles, each profile further comprising a landing and each profile landing correlates to a separate azimuthal setting of the deflector shoe for installing substantially perpendicular boreholes into the formation surrounding the main wellbore; and wherein said outer member comprises at least one pin extending out from the inside wall of said outer member and configured to mate with said slot.

In one embodiment, the profile landing is configured to catch and set the pin in a locked position.

Still further according to the invention, a system for installing substantially perpendicular boreholes in the formation surrounding a main wellbore having a casing with a longitudinal axis comprises a working string supported on the surface at the upper end of said main wellbore; an indexing tool releasably aft ached to said working string, and including an indexing deflector comprising an inner member and an outer member that encircles said inner member and that has at least one slot that runs along the inside wall of said outer member, said inner member and said outer member being configured to fastenably rotate about one another during operation and a deflector shoe. The indexing deflector is configured to move the deflector shoe from a first azimuthal setting to at least a second azimuthal setting for the installation of substantially perpendicular boreholes at each azimuthal setting through said opening in response to vertical manipulation of the deflector shoe. Further, a tubing anchor is releasably attached to said indexing tool and is configured to lock at least part of said indexing tool at a predetermined depth within said main wellbore during operation of said indexing tool. The indexing tool comprises an opening therethrough configured to (a) receive a borehole forming member from said working string, and (b) act as a guide path for said borehole forming member through said opening to install substantially perpendicular casing holes and substantially perpendicular boreholes in the formation surrounding the main wellbore with respect to the longitudinal axis, and the indexing tool is configured to mechanically move from a first setting to at least a second setting for the installation of substantially perpendicular boreholes with respect to the longitudinal axis of the main wellbore at each setting through said opening while the borehole forming member remains downhole in response to vertical manipulation by the working string. In addition, the slot comprises one or more profiles, each profile further comprising a landing wherein each profile landing correlates to a separate azimuthal setting of the deflector shoe for installing substantially perpendicular boreholes into the formation surrounding the main wellbore; and wherein said inner member comprises at least one pin extending out from the outside wall of said inner member.

BRIEF DESCRIPTION

Figure 1:
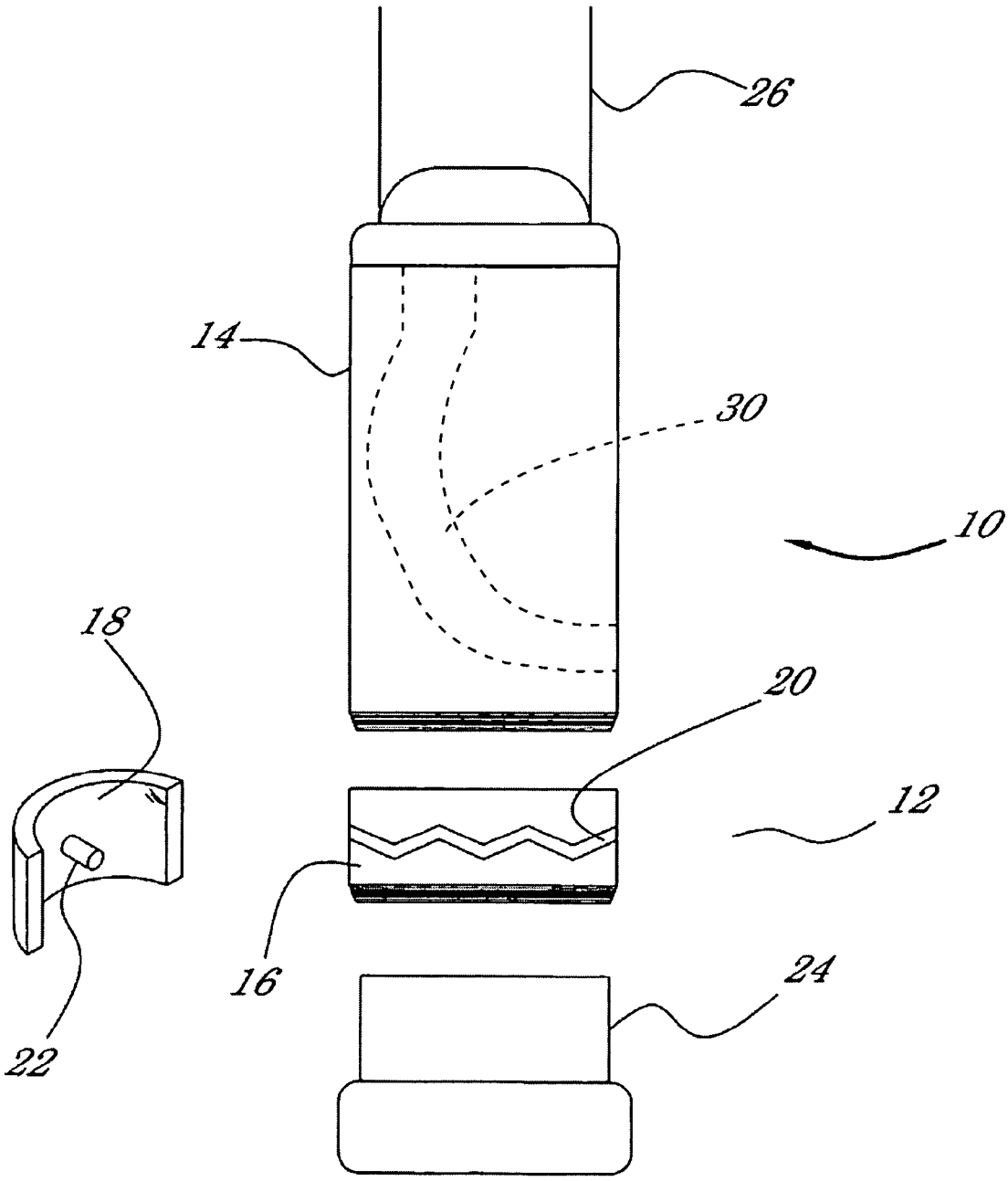
FIG. 1 illustrates an exploded side view of the indexing tool, tubing anchor and working string.

An apparatus, described herein as an "indexing tool", may be configured to direct a casing hole forming member, for example a drill bit, to form one or more holes in a main wellbore casing prior to directing a borehole forming member, for example a jetting assembly, through each of the holes for the purpose of installing boreholes in the formation surrounding the main wellbore. The indexing tool described herein can be configured so that each of the desired casing holes may be formed in advance so that each of the desired boreholes may be suitably installed in succession without having to remove the borehole forming member from the main wellbore in order to form any additional holes in the wellbore casing using the casing hole forming member. The indexing tool described herein can be configured so that multiple boreholes may be installed in the formation surrounding the main wellbore (a) along one or more azimuthal strikes, and (b) on one or more planes. Heretofore, such a desirable achievement has not been considered feasible, and accordingly, the apparatus, system, and method of this application measure up to the dignity of patentability and therefore represent patentable concepts.

In one aspect, the application provides an indexing tool, system and method for forming multiple holes in a main wellbore casing prior to installing at least a first borehole through a first casing hole.

In another aspect, the application provides an indexing tool, system and method for installing all desired boreholes through the casing holes prior to removing the jetting assembly from the main wellbore.

In another aspect, the application provides an indexing tool, system and method for drilling holes in the main wellbore casing at different depths along the main wellbore.

In another aspect, the application provides an indexing tool, system and method wherein each hole drilled into the main wellbore casing can be relocated, re-entered and/or re-accessed for the installation of boreholes, and subsequently for stimulation or the installation of a liner in the borehole.

In another aspect, the application provides an indexing tool, system and method for positioning a second set of boreholes adjacent a first set of boreholes along the length of the main wellbore, wherein each of the boreholes are directed perpendicular to the axis of the main wellbore along common azimuthal strikes. This borehole configuration allows for effective positioning of a hydraulic fracture treatment or acid treatment in a known direction.

In another aspect, the application provides an indexing tool, system and method further providing relatively low cost exposure of a main wellbore to a coal seam or hydrocarbon reservoir.

In another aspect, the application provides an indexing tool, system and method for the rapid installation of boreholes from a main wellbore.

In another aspect, the application provides an indexing tool, which can remain in the main wellbore after each of the boreholes have been installed so that each of the boreholes can be relocated, re-entered and/or re-accessed at a future date.

In another aspect, the application provides an indexing tool, which can be removed from the main wellbore and then reinserted into the main wellbore at a later date to the same depth and orientation to allow previously formed casing holes and previously installed boreholes to be relocated, re-entered and/or re-accessed.

In another aspect, the application provides an indexing tool, system and method for installing multiple boreholes along a common azimuthal setting in a stacked alignment.

In another aspect, the application provides an indexing tool, system and method for forming all desired holes in the main wellbore casing at various depths and along various azimuthal settings and providing for subsequent installation of boreholes through each of the casing holes.

In another aspect, the application provides an indexing tool, system and method for the re-entry of each borehole at a future time for re-work or stimulation purposes.

In another aspect, the application provides an indexing tool configured to remain in the main wellbore following the installation of each of the boreholes in order to re-located, re-entered and/or re-access the boreholes at a future date.

In another aspect, the application provides an indexing tool, system and method for installing boreholes along the length of a non-cased section of the main wellbore in a sequential manner without requiring the borehole forming member to be removed from the wellbore.

In another aspect, the application provides an indexing tool, system and method for installing radial boreholes with little or no damage to the formation surrounding the main wellbore.

In another aspect, the application provides an indexing tool, system and method for installing multiple stacks of boreholes at different vertical planes along multiple azimuthal settings.

In another aspect, the application provides an indexing tool wherein it is cost effective to leave the indexing tool in the main wellbore following the installation of the boreholes to eliminate the cost associated with removing the indexing tool from the main wellbore.

In another aspect, the application provides an indexing tool, which can be removed from a first position in the main wellbore by means of an orienting muleshoe device, and subsequently run back into the main wellbore wherein the indexing tool can be reset at the first position including the same depth and orientation from which is was removed.

In another aspect, the application provides an indexing tool, system and method for increasing the depth at which boreholes can be extended from the main wellbore.

In another aspect, the application provides an indexing tool, system and method for installing low cost radial boreholes from a main wellbore in a hydrocarbon environment, including for example, an oil & gas reservoir or a coal seam.

In another aspect, the application provides an indexing tool, system and method effective to reduce the number of bending cycles of any coiled tubing used during installation of the radial boreholes.

In another aspect, the application provides an indexing tool, system and method effective to be used in the rehabilitation of pre-existing wellbores to increase the daily production or to increase the recovery of hydrocarbon reserves.

In another aspect, the application provides an indexing tool, system and method effective for the perforation of new wellbores by replacing explosive charges to form one or more extended "tunnels" in the surrounding formation.

Discussion of the Indexing Tool

To better understand the novelty of the indexing tool, system and methods of use thereof, reference is hereafter made to the accompanying drawings. FIG. 1 shows one embodiment of the indexing tool 10 comprising at least an indexing deflector 12 (herein referred to as a "deflector") and a deflector shoe 14. The indexing tool 10 is suitably attached to a tubing anchor 24 at a first end and attached to a working string 26 at a second end. In particular, a first end of deflector shoe 14 is releasably attached to a second end (i.e., the surface end) of the deflector 12. Likewise, a second end of the deflector shoe 14 is configured to releasably attach to first end of working string 26, while a first end of deflector 12 is configured to releasably attach to tubing anchor 24. Collectively, the indexing tool 10, tubing anchor 24, and working string 26 may suitably be configured to:

(A) orient a casing hole forming member (1) along one or more azimuthal settings about the central axis of the indexing tool 10 and (2) on one or more planes along the length of the main wellbore for cutting one or more holes in the main wellbore casing 28 prior to removing the casing hole forming member from the main wellbore; and (B) orienting a borehole forming member into the main wellbore to a point corresponding to each of the desired casing holes along the one or more azimuthal settings for installing one or more boreholes into the formation surrounding the main wellbore.

Figure 2:
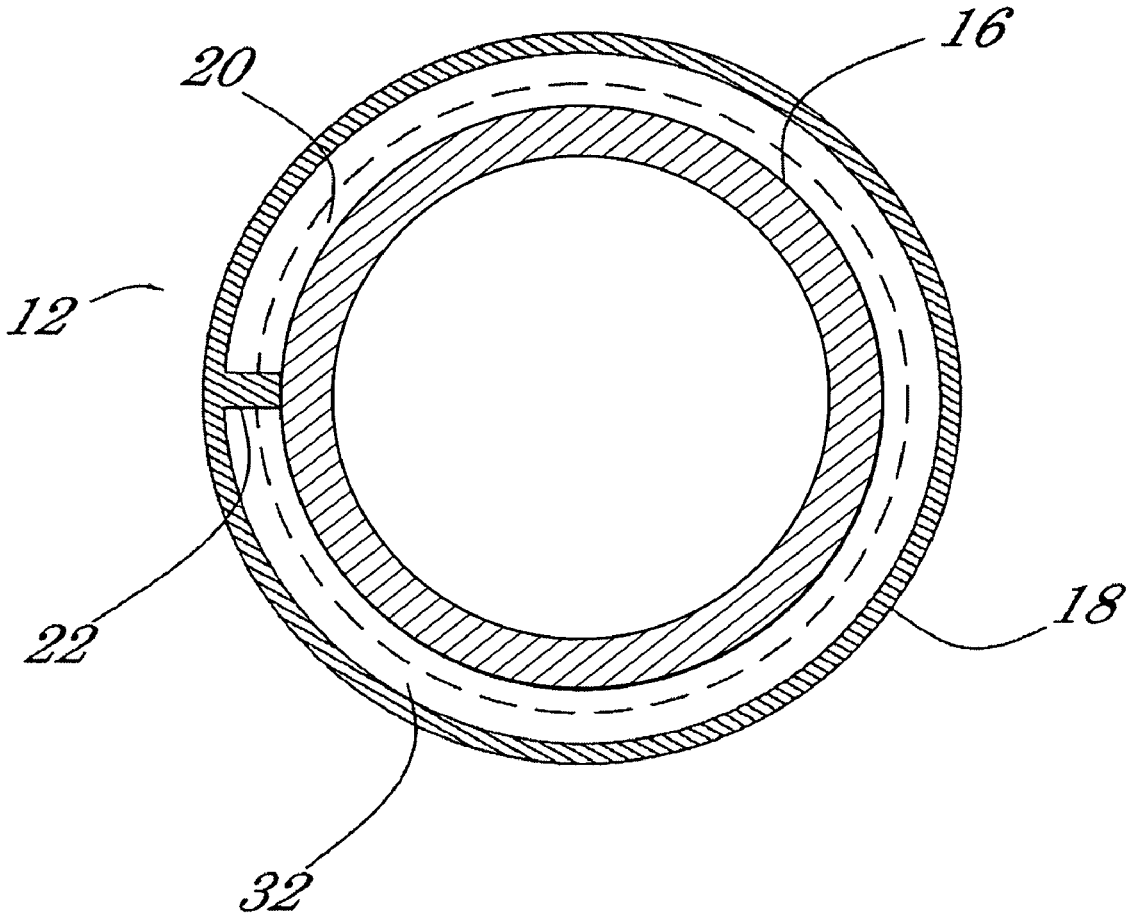
FIG. 2 illustrates a top view of the indexing deflector in a secured position.

In one embodiment, the deflector 12 comprises a cylindrical inner member 16 and a cylindrical outer member 18 (partially shown in FIG. 1). Suitably, the outer diameter of inner member 16 is slightly less than the inner diameter of outer member 18 wherein the outer member 18 is configured to encircle the inner member 16—as shown in FIG. 2. Suitably, outer member 18 and inner member 16 are configured to fastenably rotate about one another during operation of the indexing tool 10. In a particularly advantageous embodiment, the outer member 18 is configured to fastenably rotate about a fixed inner member 16. In the alternative, the inner member 16 can be configured to fastenably rotate within a fixed outer member 18.

As shown in FIG. 1, the inner member 16 suitably comprises at least one slot 20 that runs along the outer periphery of inner member 16. The slot can be further described as a groove cut into the outer wall of inner member 16 that comprises a predetermined depth and width. As shown in FIG. 1, the outer member 18 suitably comprises at least one pin 22 that extends out from the inside wall of outer member 18 and is configured to mate with slot 20. In the alternative, outer member 18 can comprise at least one slot 20 that runs along its inside wall and inner member 16 can comprise at least one pin 22 that extends out from the outside wall of the inner member 16. Although the indexing tool 10 described herein is not limited to any particular size or shape, in a suitable embodiment directed to known drilling operations, the indexing tool 10 includes an inner member 16 comprising a wall thickness from about 2.54 cm to about 10 cm (from about 1.0 inch to about 4.0 inches); an outer member 18 comprising a wall thickness from about 1.25 cm to about 2.54 cm (from about 0.5 inches to about 1.0 inches). In a particularly advantageous embodiment of the indexing tool 10, the inner member 16 comprises a wall thickness of about 7.62 cm (about 3.0 inches), and the outer member 18 comprises a wall thickness of about 2.54 cm (about 1.0 inches). In addition, inner member 16 and outer member 18 comprise about equal lengths. In a suitable embodiment directed to known drilling operations, members 16 and 18 comprise a length from about 30 cm to about 60 cm (about 12 inches to about 24 inches). In a particularly advantageous embodiment, members 16 and 18 comprise a length of about 45 cm (about 18 inches).

The slot 20 suitably comprises, but is not limited to a width from about 1.27 cm to about 2.54 cm (from about 0.5 inches to about 1.0 inches) and a depth from about 1.27 cm to about 2.54 cm (from about 0.5 inches to about 1.0 inches). In a particularly advantageous embodiment, the slot 20 may comprise a width of about 1.9 cm (about 0.75 inches) and a depth of about 1.9 cm (about 0.75 inches). Suitably, pin 22 comprises a width or outer diameter slightly less than the width of slot 20.

In one embodiment, the slot 20 comprises a predetermined length including a first edge and a second edge defining the distance that pin 22 can travel along slot 20—a distance less than 360° about the outer periphery of inner member 16. In another embodiment, as shown in FIG. 2, the slot 20 comprises a seamless configuration along inner member 16 wherein pin 22 can travel at least 360° along slot 20 about inner member 16. In yet another embodiment, slot 20 comprises a predetermined length including a first edge and a second edge wherein pin 22 can travel about inner member 16 a distance greater than 360°.

In the embodiments herein described, slot 20 can comprise one or more profiles, either repeatable profiles, non-repeatable profiles or a combination of repeatable and non-repeatable profiles, whereby slot 20 is configured so that pin 22 can travel the length of each profile. Suitably, each profile further comprises one or more landings configured to catch and set pin 22 in a locked position. Herein, each locked position of pin 22 correlates to a separate setting of the deflector shoe for installing boreholes into the formation surrounding the main wellbore. In other words, each profile landing correlates to a separate setting of the deflector shoe for installing boreholes into the formation surrounding the main wellbore. In addition, the locked position of pin 22 further secures the inner member 16 to the outer member 18. Thus, the locked position of pin 22 sets the deflector shoe 14 in a fixed position for orienting both a casing hole forming member and a borehole forming member along one or more azimuthal settings about the central axis of the indexing tool 10 for installing boreholes into the formation surrounding the main wellbore.

Figure 3:
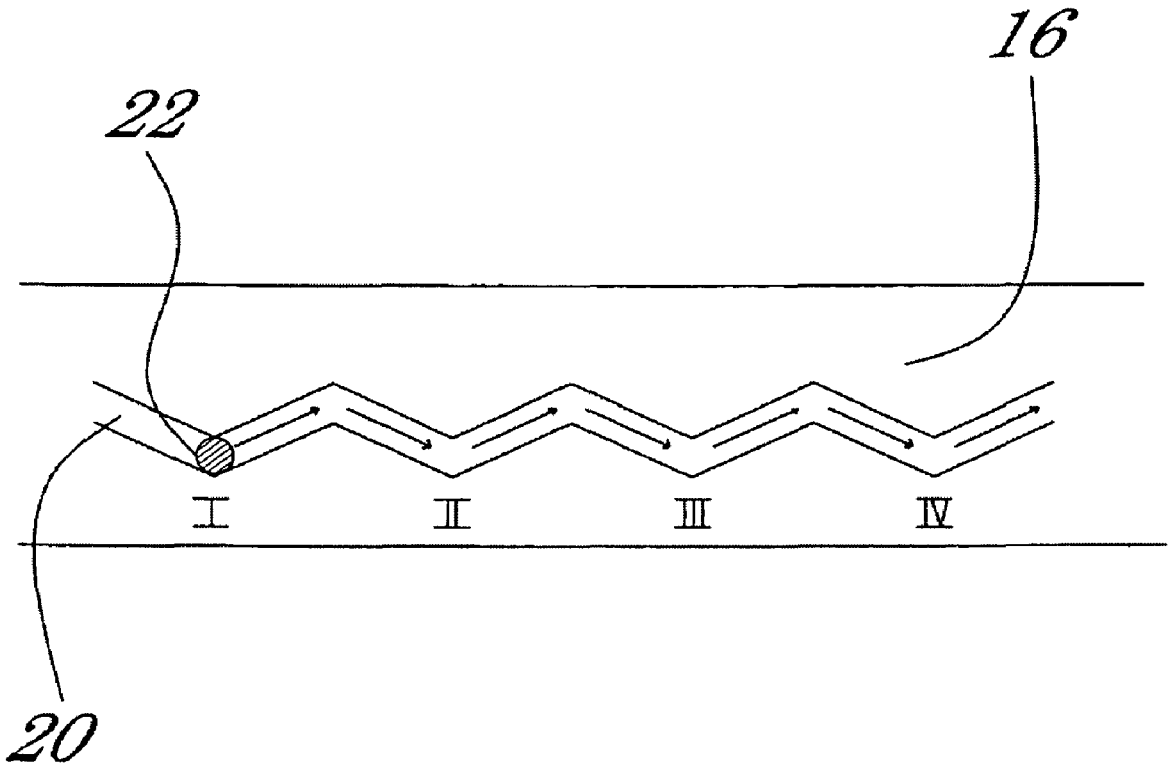
FIG. 3 illustrates a side view of the inner member of the indexing deflector including a J-slot comprising multiple landings.

In one suitable embodiment, as shown in FIG. 3, slot 20 can comprise one or more "J-slot" profiles, wherein each J-slot profile includes a landing (labeled as landings I-IV), which are aligned along about the same vertical plane of inner member 16. In another suitable embodiment, slot 20 can be configured along the inner member 16 so that each of the profile landings can be aligned along the same azimuthal setting for installing a borehole, but on different planes along the length of the inner member 16—forming a stacked configuration of radial boreholes along the same azimuthal setting or same azimuthal strike.

Figure 6:
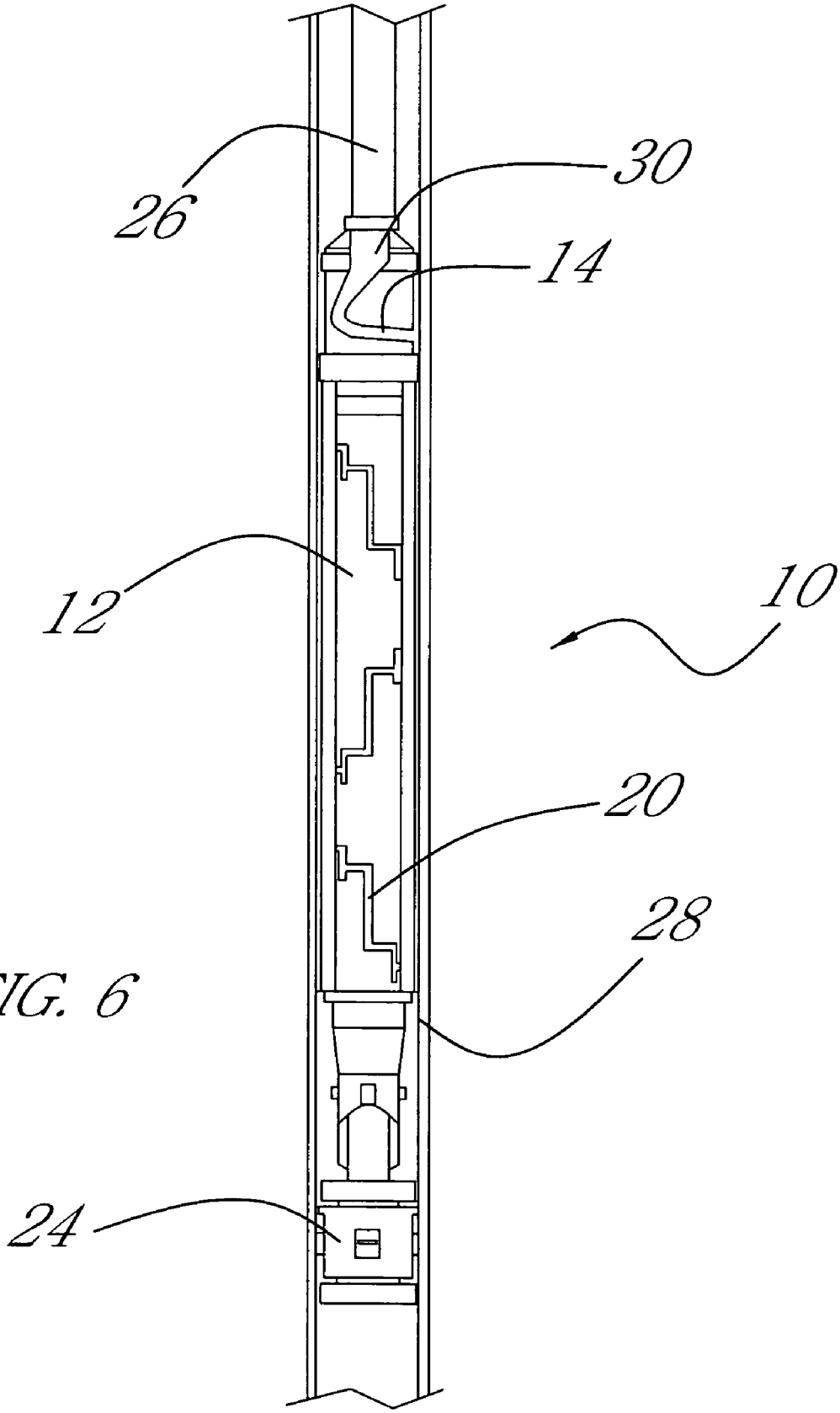
FIG. 6 illustrates a side view of the indexing deflector including a slot comprising a helical-type pattern.
Figure 7A:
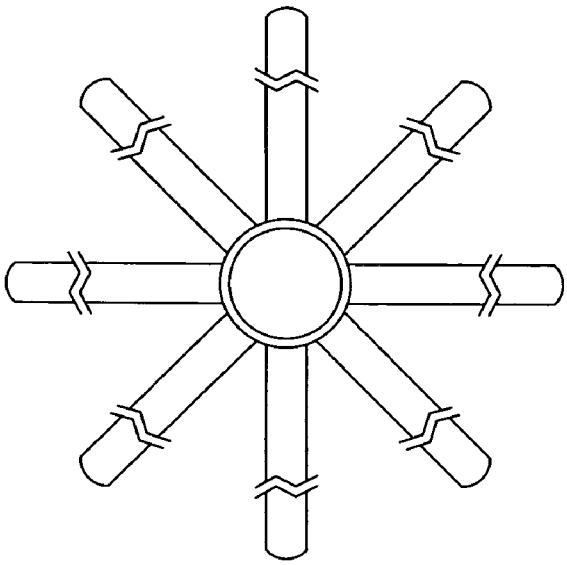
FIG. 7*a* illustrates a top view of multiple radial boreholes along multiple azimuthal strikes formed using the indexing tool described herein.
Figure 7B:
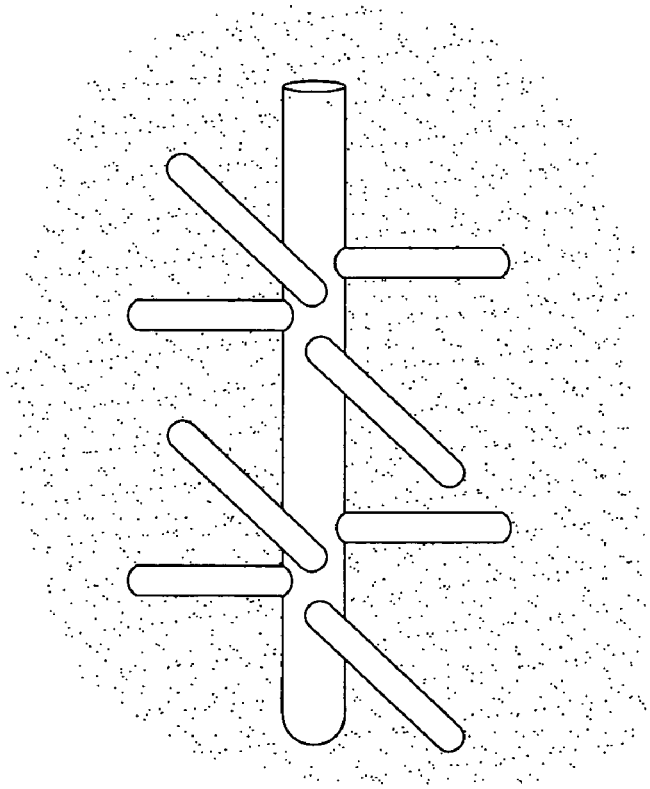
FIG. 7*b* illustrates a perspective view of multiple radial boreholes along multiple azimuthal strikes formed using the indexing tool described herein.

As shown in FIG. 6, slot 20 can further comprise a helical type pattern along the inner member 16 wherein each of the profile landings are aligned along multiple planes at multiple azimuthal settings about inner member 16. Herein, both a casing hole forming member and a borehole forming member can be oriented along each of the azimuthal settings for installing radial boreholes into the formation surrounding the main wellbore, as represented by FIG. 7*b*.

As shown in FIGS. 1 and 2, pin 22 is configured to extend out a predetermined distance from the inside wall of outer member 18. Suitably, pin 22 is configured to (1) mate with slot 20, (2) travel the length of slot 20 engaging each profile landing to secure the inner member 16 and outer member 18 against undesired rotation of either member 16 or 18, and (3) fasten the outer member 18 to the inner member 16 during operation. Although pin 22 is not limited to any particular shape, in a particularly advantageous embodiment, pin 22 is cylindrically shaped comprising an outer diameter slightly less than the width of slot 20.

In one embodiment, outer member 18 is configured to attach to deflector shoe 14 via a threaded connection, and inner member 16 is configured to attach to tubing anchor 24 via a threaded connection. In the alternative, outer member 18 can be configured to attach to tubing anchor 24, and inner member 16 can be configured to attach to deflector shoe 14. Although outer member 18 can be configured to lie flush along the outside wall of inner member 16, during operation it is desirable sometimes to include a spacing 32 between the outer member 18 and inner member 16 of from about 0.4 mm to about 1.59 mm (from about 0.016 inches to about 0.063 inches). In a particularly advantageous embodiment, the spacing 32 between the outer member 18 and inner member 16 is about 1.2 mm (about 0.05 inches).

Figure 4:
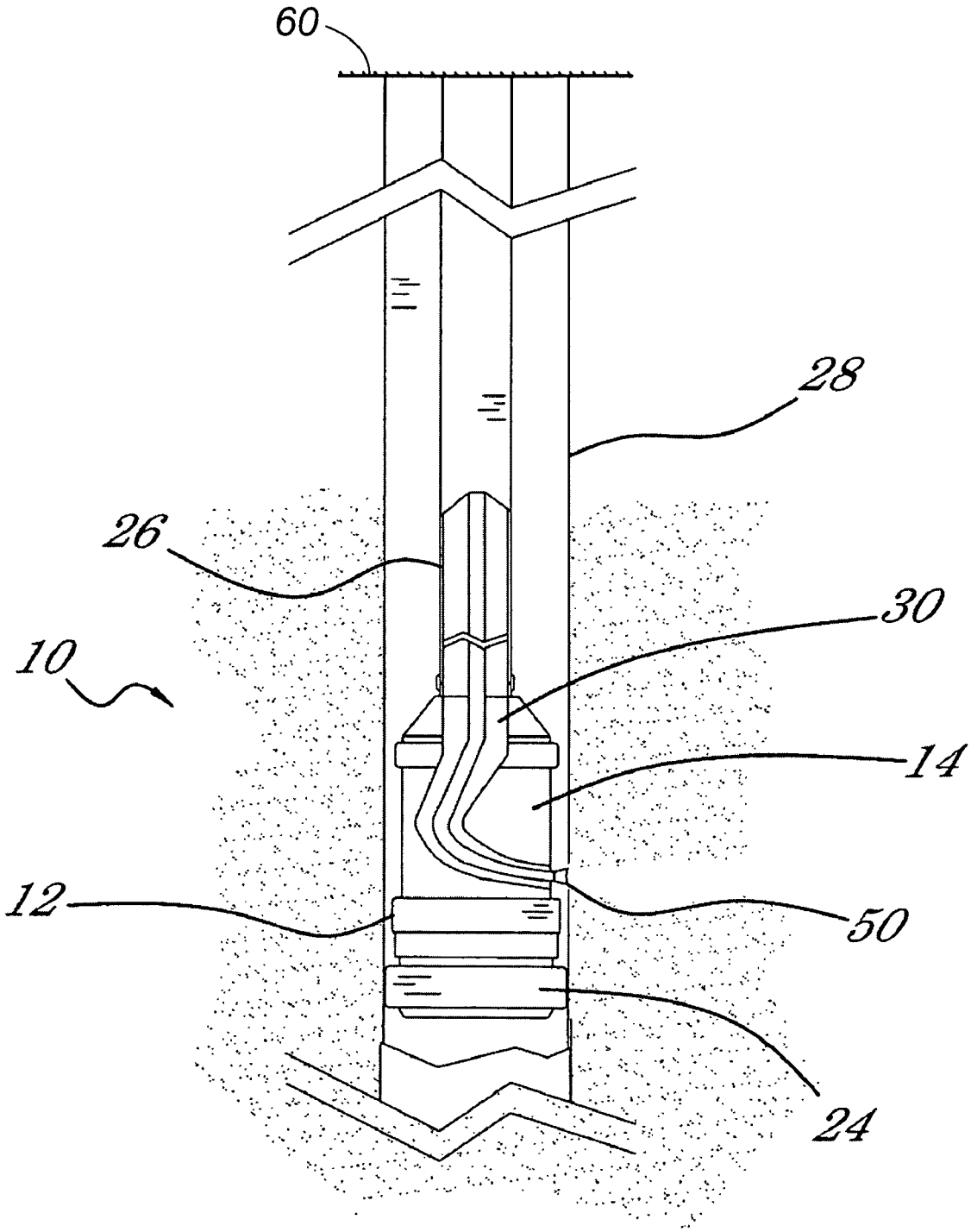
FIG. 4 illustrates a side view of the indexing deflector including a drill bit for cutting a hole in the wellbore casing.
Figure 5:
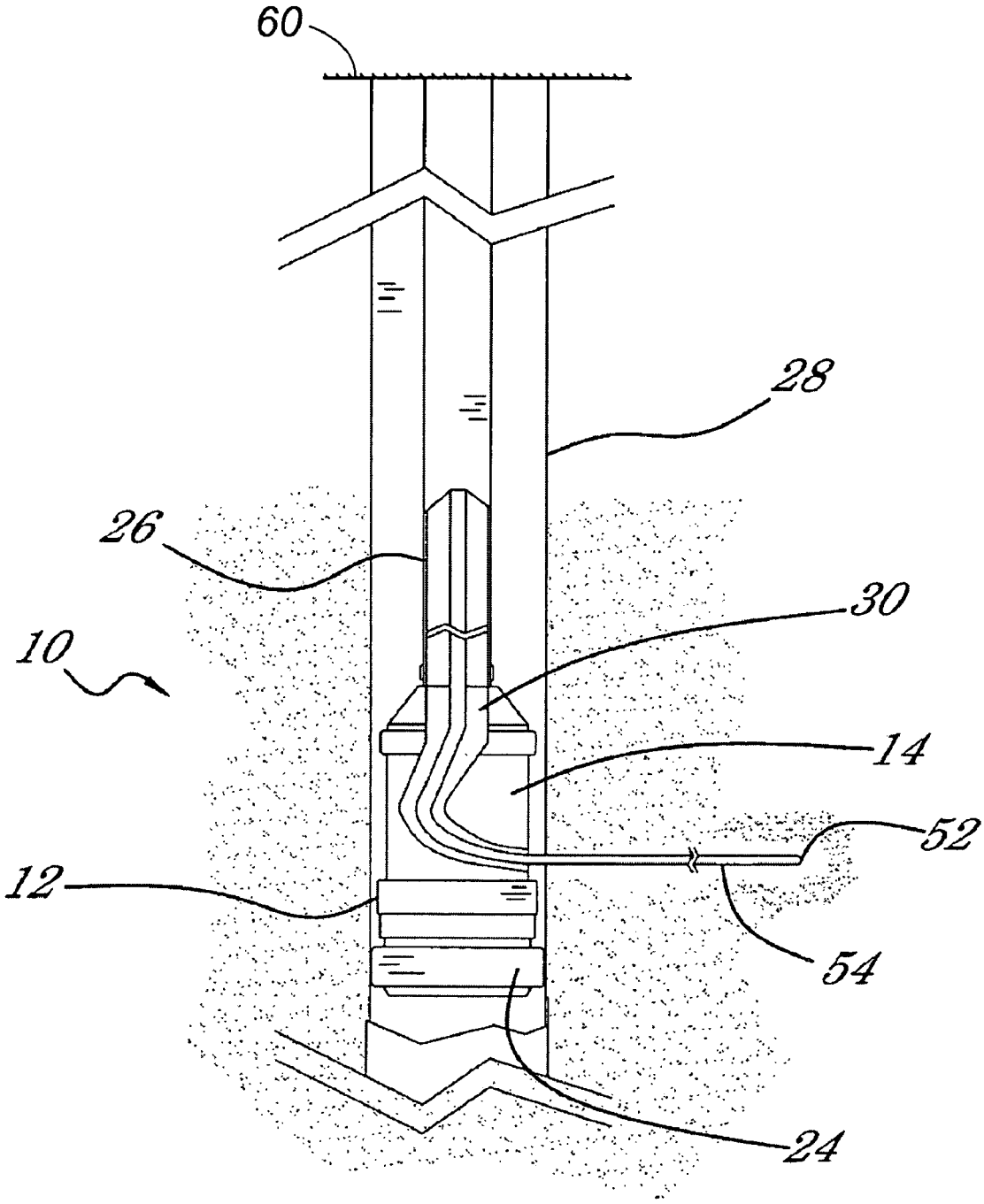
FIG. 5 illustrates a side view of the indexing deflector including jetting assembly for installing a borehole into the formation surrounding a main wellbore.

As shown in FIG. 1, deflector shoe 14 is configured to attach to deflector 12 at a first end and is configured to attach to working string 26 at a second end. In a suitable embodiment, the deflector shoe 14 can be configured to (1) guide a casing hole forming member, for example a drill bit 50 on the end of a mud motor, a turbine drill with a speed reducer, or other device known to those of ordinary skill in the art, to a position abutting casing 28 wherein a hole can be drilled in casing 28—as shown in FIG. 4; and (2) guide a borehole forming member, for example a jet assembly including a jet head 52 attached to the end of a jetting string 54, through the hole cut in the casing 28 for installing radial boreholes into the formation surrounding the main wellbore—as shown in FIG. 5. Suitably, the jet assembly is configured so that the jet head 52 is threadably attached to the jetting string 54, which is further attached at the surface to coiled tubing. As known to those of ordinary skill in the art, the jet head 52 can include a plurality of holes pointing in a rearward orientation in relation to the forward end of the jet head 52, resulting in an acceleration force of the jet head 52 in a forward direction. In addition, a suitable jetting string 54 can comprise, for example, a flexible hose.

Suitably, the deflector shoe 14 comprises a tubular housing defined by an opening 30 therethrough, wherein the opening 30 is configured to act as a guide path for the casing hole member and borehole forming member. In one embodiment, the opening 30 may suitably comprise a bend wherein the inlet and outlet of the opening 30 are from slightly greater than 0° up to about 90° to each other. In a particularly advantageous embodiment, the inlet and outlet of the opening 30 are about 90° to each other, which allows for the installation of lateral boreholes in relation to the central axis of the main wellbore. In yet another embodiment, the deflector shoe 14 may comprise a thruster device comprising a piston and seal wherein the piston extends and is forced against the inside wall of the casing. In this embodiment, the casing hole forming member and the borehole forming member extend through the piston.

Without limiting the indexing tool 10 to a particular size or shape, in a suitable embodiment, the opening 30 comprises a diameter or width from about 1.27 cm to about 3.75 cm (from about 0.5 inches to about 1.5 inches). In a particularly advantageous embodiment, opening 30 comprises a diameter or width great enough to accommodate both a casing hole forming member and a borehole forming member having diameters of about 1.27 cm (about 0.5 inch). Suitably, the deflector shoe 14 can be formed from a solid piece of construction, or from tubular stock. Where the deflector shoe 14 comprises a solid piece of construction, the deflector shoe 14 can be split lengthwise wherein identical mirror image type grooves are milled or otherwise formed into each split section to form opening 30. Once the grooves are formed, the two sections are sealably or releasably attached using for example, welds or screws.

As shown in FIG. 1, the tubing anchor 24 is suitably positioned on the downstream side of deflector 12 wherein the tubing anchor 24 is configured to releasably attach to a first end of the deflector 12. In a particularly advantageous embodiment, the tubing anchor 24 is releasably attached to inner member 16 via a threaded connection. Suitably, the tubing anchor 24 can be set in the main wellbore by left-hand rotation and released by right-hand rotation, or in the alternative, the tubing anchor 24 can be set in the main wellbore by right-hand rotation and released by left-hand rotation. Thus, the tubing anchor 24 can be configured so that the rotation of the working string 26 in a particular direction acts on the tubing anchor 24 to extend pads located on the tubing anchor 24 to create a force against the inside wall of casing 28 (i.e., an activated position). The force applied to the inside wall of the casing 28 prevents any undesired rotation or other movement of the tubing anchor 24, indexing tool 10, and working string 26 during operation. As necessary, the tubing anchor 24 can be de-activated by rotating the working string 26 in the opposite direction, or in the alternative, by introducing a pulling force that exceeds a preset level, as understood by those of ordinary skill in the art.

Herein, suitable tubing anchors 24 include devices commonly used in oil and gas industry to prevent the rotation or reciprocation of a working string during production operations. Suitable tubing anchors include for example, standard mechanical packers, and hydraulic packers. Tubing anchors 24 can be acquired from the following commercial sources: Weatherford International of Houston, Tex. and Baker Oil Tools of Houston, Tex.

The working string 26 described herein comprises production tubing common to oil and gas production operations. Suitably, the working string 26 comprises steel tubes or comparable material including for example, aluminum, fiberglass, or composite materials that have threaded connections on either end of each section of the working string. Thus, each section of working string can be coupled together to form a single contiguous working string 26 comprising a desired length.

In operation, the second end of working string 26 is supported on the surface 60 along the top portion of the casing 28 at the upper end of the main wellbore. For example, the working string 26 can be supported at the surface 60 by slips as understood by those of ordinary skill in the art. In addition, the working string 26 can be formed from coiled tubing, and although not limited to any particular dimensions, a suitable working string comprises an outer diameter from about 5.08 cm to about 10.16 cm (from about 2 inches to about 4 inches). In a particularly advantageous embodiment, the working string 26 comprises an outer diameter of about 7.3 cm (about 2.875 inches).

Suitably, the indexing tool 10 is constructed of a material or materials including but not necessarily limited to, materials resistant to chipping, cracking, and breaking as a result of ozone, weathering, heat, moisture, other outside mechanical and chemical influences, as well as violent physical impacts. Suitable materials include, for example, composite materials, plastics, ferrous metals, non-ferrous metals, and combinations thereof. In one embodiment, the indexing tool 10 is comprised of dense plastic. In another embodiment, the indexing tool 10 is comprised of polytetrafluoroethylene (PTFE). In another embodiment, the indexing tool 10 is comprised of stainless steel. In a particularly advantageous embodiment, the indexing tool 10 is comprised of high carbon steel, including for example, 4140 Grade high carbon steel.

Discussion of the Method for Installing Radial Boreholes

The application is further directed to a method employing the above indexing tool for installing one or more boreholes (also referred to as "radial boreholes") into the formation surrounding the main wellbore. Herein, the method of installing boreholes from a main wellbore can be described as "rapid installation." Specifically, in an embodiment including a casing inside the main wellbore, "rapid installation" refers to forming each desired hole in the casing prior to installing each desired borehole through the casing holes out past the casing in the formation surrounding the main wellbore. Thus, in another embodiment, the indexing tool 10 can be assembled as illustrated and utilized in a main wellbore for installing one or more boreholes in the formation surrounding the main wellbore, as shown in FIGS. 4 and 5.

The first step in the installation of the indexing tool 10 involves setting the tubing anchor 24 at a predetermined depth inside the main wellbore along casing 28. It is not critical that the tubing anchor 24 be set at any particular orientation inside the main wellbore, because forthcoming azimuthal settings are determined by the orientation of the deflector shoe 14 of indexing tool 10. As previously discussed, once the tubing anchor 24 has been set at a predetermined depth, the tubing anchor 24 may be fixed to the casing 28 to prevent rotation or reciprocation of the working string 26 during operation of the indexing tool 10. Particularly, the tubing anchor 24 can be fixed to the casing 28 by rotating the working string 26 in one direction, which causes pads on the tubing anchor 24 to extend to create a force against the inside walls of the casing 28.

Once the tubing anchor 24 is fixed to the casing 28, the indexing tool 10, which is suitably attached to working string 26 at a second end, can be cycled into the main wellbore and oriented along a first suitable azimuthal setting wherein (1) one or more holes can be formed in the wellbore casing 28 and (2) at least a first borehole can be installed in the formation surrounding the main wellbore through one of the casing holes. A first azimuthal setting of indexing tool 10 corresponds to a first set position between inner member 16 and outer member 18 wherein at least one pin 22 of outer member 18 is set in a profile landing of slot 20. In operation, the actual alignment of the indexing tool 10 may sometimes vary from the desired setting by up to about 15 degrees laterally in relation to the central axis of the indexing tool 10. However, the tubing anchor 24 can be reset and the indexing tool 10 can be recycled into the main wellbore if necessary to realign the indexing tool 10 more accurately.

In an embodiment including a casing inside the main wellbore, the installation of a first borehole in the formation surrounding the main wellbore requires forming a first hole in the casing 28. In one embodiment, a casing hole forming member, including a drill bit 50 or similar device, can be led by a mud motor connected by knuckle joints through opening 30 to a predetermined point adjacent the inside wall of the casing 28. In an embodiment using a drill bit 50, the drill bit 50 is configured to drill or cut a first hole in the casing 28 without advancing further into the surrounding formation past the casing 28. In a particularly advantageous embodiment, drill bit 50 includes a boss ring of larger diameter than the drill bit 50 that is configured to contact the inside wall of casing 28 to prevent drill bit 50 from advancing into the surrounding formation past the outside wall of casing 28. Once the first hole has been formed, the indexing tool 10 can be manipulated to set the deflector shoe 14 along a second setting by directing pin 22 to a second desired landing along slot 20. Once the deflector shoe 14 is set in a second setting, a second hole can be formed in the casing 28.

In an embodiment of the indexing tool 10, wherein inner member 16 is attached to the tubing anchor 24, and outer member 18 is attached to deflector shoe 14, the deflector 12, may be suitably configured to both direct the deflector shoe 14 from a first azimuthal setting to at least a second azimuthal setting and fix the deflector shoe 14 in at least a second azimuthal setting as described below:

(1) the working string 26, which is attached to the second end of the deflector shoe 14, can be rotated at the surface 60, which in turn directs the deflector shoe 14 and outer member 18 in a corresponding direction. Suitably, movement of outer member 18 toward the surface 60 releases the pin 22 of outer member 18 from the slot landing of inner member 16;

(2) once the pin 22 has been released from the landing of slot 20, the working string 26, deflector shoe 14 and outer member 18 can be rotated thereby guiding the pin 22 a predetermined distance along slot 20 until the pin 22 engages the next desired landing of slot 20—this may or may not include the next landing in succession along slot 20. With reference to FIG. 3, as working string 26 rotates, the pin 22 can be guided from landing I to landing II, or in the alternative, pin 22 can be guided from landing I to a non-consecutive landing such as landing III or IV.

Figure 8:
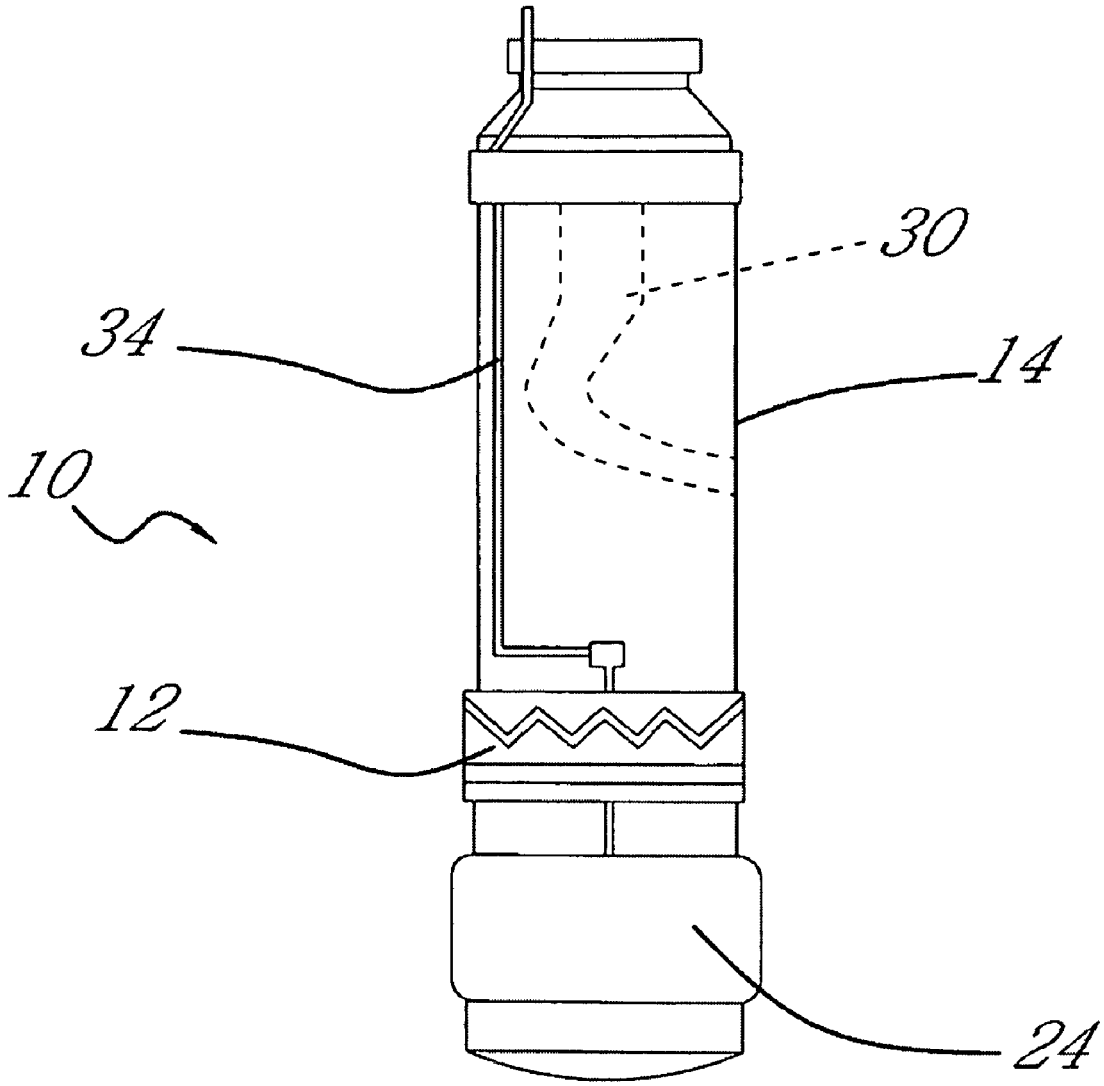
FIG. 8 illustrates a side view of an embodiment of the indexing tool including a hydraulic line.

Suitably, the working string 26 can be manually lifted or shifted, or in the alternative, hydraulically lifted or shifted using a hydraulic line 34 as shown in FIG. 8. Manual operation comprises techniques known to those of ordinary skill in the art including, for example, grabbing the working string 26 with a service rig, lifting the working string 26 and rotating the working string 26 with a torque wrench or power swivel so that pin 22 can engage a desired landing of slot 20.

In an embodiment comprising hydraulic line 34, hydraulic pressure from pumps located at the surface can force the outer member 18 to move axially along the length of working string 26 in relation to inner member 16. In an example where slot 20 is configured along inner member 16 in a helical formation, the hydraulic pressure can force the outer member 18 to rotate about inner member 16 whereby pin 22 can be guided along slot 20 to a desired landing. Hydraulic operation may further include at least a first spring (not shown) positioned between inner member 16 and outer member 18 that is configured to force members 16 and 18 together once pressure is removed. In this embodiment, the first end of the deflector shoe 14 can be mounted to a shaft (not shown) that is configured to rotate and guide the deflector shoe 14 axially along the length of the working string 26. Herein, fluid pressure from the surface forces outer member 18 axially along the length of the working string 26 towards tubing anchor 24 causing outer member 18 to rotate, which in turn causes the deflector shoe 14 to rotate. As outer member 18 is forced towards tubing anchor 24, pin 22 ultimately contacts at least a first landing of slot 20. At this landing position of pin 22, pump pressure is stopped and the one or more springs, located on the bottom end of outer housing 18 which have been compressed by the forced movement of the outer housing 18, are configured to uncoil thereby guiding the deflector shoe 14 to the next desired setting.

The pressure from one or more pumps on the surface acts suitably against a piston (not shown) located in the indexing tool 10, causing the piston to travel a predetermined length. A lug (not shown) located on the outer surface of the piston is configured to travel within a curved milled slot on the inner surface of the outer member 18, causing the outer member 18, which is attached to the deflector shoe 14, to rotate about inner member 16 as the lug moves along the slot. As the piston travels, the piston acts on a spring forcing the spring to compress. Once the piston reaches a predetermined maximum travel distance, the pump is stopped or otherwise shut off. Once the pressure is stopped, the spring pushes the piston back to the starting position wherein the deflector shoe 14 has been rotated from a first azimuthal setting to a second azimuthal setting.

Once all desired holes have been formed in the casing 28, the casing hole forming member can be removed from the main wellbore and replaced with a borehole forming member. A borehole forming member, for example a jetting assembly including a jet head 52 or similar device, can be led into the main wellbore to a point corresponding to each of the desired casing holes along the one or more azimuthal settings. From each casing hole, one or more boreholes can be installed in the formation surrounding the main wellbore out past the casing 28.

As mentioned above, the jet head 52 of jet assembly can comprise a plurality of holes pointing in a rearward orientation in relation to the forward end of the jet head 52 wherein the holes are configured to form one or more rearward facing jets, which results in an acceleration force directing the jet head 52 forward into the surrounding formation. The jet head 52 can be configured to include one or more forward facing jets configured to break down or otherwise loosen the surrounding formation out in front of the forward facing jets. The force of the fluid from the forward facing jets causes the surrounding formation, for example, reservoir rock, to become powderized thereby forming a hole out in front of the jet head 52 through which the jet head 52 can be further advanced to form a radial borehole having a desired depth out from the main wellbore.

In another embodiment, the indexing tool 10 is effective for the installation of one or more boreholes in the formation surrounding the main wellbore in a section of the main wellbore where no casing is present. In this embodiment, where a drill bit 50 is not necessary, all radial boreholes can be installed into the formation surrounding the main wellbore once the indexing tool 10 is set along a first azimuthal setting inside the main wellbore.

In addition, the indexing tool 10 described herein can be stored or kept in the main wellbore during drilling operations and relocated by attaching a top sub to the indexing tool 10. Suitably, the top sub, which includes a muleshoe orienting profile, is configured so that a mating tool attached to the first end of working string 26 can be run into the main wellbore at a later date and latched to the indexing tool 10—allowing any previously installed radial borehole to be relocated, re-entered and/or re-accessed.

In another embodiment, the indexing tool 10 can be removed from the main wellbore during drilling operations and then can be redirected into the main wellbore at a later date. In this embodiment, the tubing anchor 24 remains fixed inside the main wellbore after removal of the indexing tool 10. Herein, (1) an orientation sub, which includes a muleshoe orienting profile comprising at least one lug, is attached to the surface end of the tubing anchor 24, and (2) a mating sub, which includes an orienting muleshoe configured to latch into the orientation sub, is attached to the first end of indexing tool 10. Once a user identifies the position of the lug on the orientation sub, which can be obtained using a gyroscope or other means known to those of ordinary skill in the art, the indexing tool 10 can be redirected into the main wellbore and the orienting muleshoe of the mating sub can be latched or locked to the lug. From this latched or locked position, the indexing tool 10 can be situated as it was when installing each of the casing holes and/or boreholes so that any of the previously installed radial boreholes can be relocated, re-entered and/or re-accessed. Particularly, when a user lifts and rotates the working string 26, the pin 22 of indexing tool 10 can engage each successive landing of slot 20—resulting in realignment of the outlet of opening 30 with each of the casing holes and/or previously installed boreholes. Each of the landing positions can be tracked at the surface either manually or by electronic means. The electronic means for tracking the position of the indexing tool 10 and corresponding drill string components or boreholes may further be a computer means. A variety of user interfaces may be employed to control and depict orientation of drill string components with respect to varying boreholes.

Example 1

In a first non-limiting example, an apparatus is used to install boreholes into the formation surrounding a main wellbore. An apparatus, as shown in FIGS. 4 and 5, is provided including the following dimensions:

| Part | Outer Diameter | Inner Diameter | Length | Material |
|---|---|---|---|---|
| Outer Member | 11.56 cm (4.55 inches) | 9.1 cm (3.6 inches) | 45.72 cm (18 inches) | High Carbon Steel |
| Inner Member | 8.89 cm (3.5 inches) | 2.54 cm (1.0 inches) | 45.72 cm (18 inches) | High Carbon Steel |
| Pin | 1.91 cm (¾ inches) | Solid | "Height" 1.91 cm (¾ inches) | High Carbon Steel |

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

I claim:

1. A system for installing substantially perpendicular boreholes in the formation surrounding a main wellbore having a casing with a longitudinal axis the system comprising:

a working string supported on the surface at the upper end of said main wellbore;

an indexing tool releasably attached to said working string and comprising an indexing deflector comprising an inner member having at least one slot that runs along the outer periphery of said inner member, and an outer member that encircles said inner member, said inner member and said outer member being configured to fastenably rotate about one another during operation; and a deflector shoe;

wherein the indexing deflector is configured to move the deflector shoe from a first azimuthal setting to at least a second azimuthal setting for the installation of substantially perpendicular boreholes at each azimuthal setting through said opening in response to vertical manipulation of the deflector shoe; and a tubing anchor releasably attached to said indexing tool and configured to lock at least part of said indexing tool at a predetermined depth within said main wellbore during operation of said indexing tool;

wherein said indexing tool comprises an opening therethrough configured to (a) receive a borehole forming member from said working string, and (b) act as a guide path for said borehole forming member through said opening to install substantially perpendicular casing holes and substantially perpendicular boreholes in the formation surrounding the main wellbore with respect to the longitudinal axis;

wherein said indexing tool is configured to mechanically move from a first setting to at least a second setting for the installation of substantially perpendicular boreholes with respect to the longitudinal axis of the main wellbore at each setting through said opening while the borehole forming member remains downhole in response to vertical manipulation by the working string;

wherein said slot comprises one or more profiles, each profile further comprising a landing;

wherein each profile landing correlates to a separate azimuthal setting of the deflector shoe for installing substantially perpendicular boreholes into the formation surrounding the main wellbore; and wherein said outer member comprises at least one pin extending out from the inside wall of said outer member, said pin being configured to mate with said slot.

2. The system of claim 1, wherein said profile landing is configured to catch and set said pin in a locked position.

3. A system for installing substantially perpendicular boreholes in the formation surrounding a main wellbore having a casing with a longitudinal axis the system comprising:

a working string supported on the surface at the upper end of said main wellbore;

an indexing tool releasably attached to said working string, and comprising:

an indexing deflector comprising an inner member and an outer member that encircles said inner member and that has at least one slot that runs along the inside wall of said outer member, said inner member and said outer member being configured to fastenably rotate about one another during operation; and a deflector shoe;

wherein the indexing deflector is configured to move the deflector shoe from a first azimuthal setting to at least a second azimuthal setting for the installation of substantially perpendicular boreholes at each azimuthal setting through said opening in response to vertical manipulation of the deflector shoe; and a tubing anchor releasably attached to said indexing tool and configured to lock at least part of said indexing tool at a predetermined depth within said main wellbore during operation of said indexing tool;

wherein said indexing tool comprises an opening therethrough configured to (a) receive a borehole forming member from said working string, and (b) act as a guide path for said borehole forming member through said opening to install substantially perpendicular casing holes and substantially perpendicular boreholes in the formation surrounding the main wellbore with respect to the longitudinal axis;

wherein said indexing tool is configured to mechanically move from a first setting to at least a second setting for the installation of substantially perpendicular boreholes with respect to the longitudinal axis of the main wellbore at each setting through said opening while the borehole forming member remains downhole in response to vertical manipulation by the working string;

wherein said slot comprises one or more profiles, each profile further comprising a landing;

wherein each profile landing correlates to a separate azimuthal setting of the deflector shoe for installing substantially perpendicular boreholes into the formation surrounding the main wellbore; and wherein said inner member comprises at least one pin extending out from the outside wall of said inner member.

4. An apparatus for installing substantially perpendicular boreholes in the formation surrounding a main wellbore casing having a longitudinal axis, the apparatus comprising:

an indexing tool comprising a deflector shoe and an indexing deflector;

the deflector shoe comprising an opening therethrough configured to receive a borehole forming member at a first end of the opening and to direct the borehole forming tool in a substantially perpendicular direction at a second end of the opening for forming a substantially perpendicular borehole in the main wellbore casing with respect to the longitudinal axis;

the indexing deflector comprising a fixed member and a moveable member;

an actuation member connected to the movable member to selectively move the movable member from a first position to at least a second position:

wherein the moveable member is connected to the deflector shoe to direct the deflector shoe from a first azimuthal setting, at which a first substantially perpendicular casing hole and borehole can be made through said opening along a first azimuthal direction, to at least a second azimuthal setting, different than the first azimuthal setting, at which a second substantially perpendicular casing hole and borehole can be made through said opening along a second azimuthal direction as the movable member is moved by the actuation member from the first to the second position, and while the borehole forming tool remains downhole.

5. The apparatus of claim 4, wherein the indexing deflector is releasably secured to the main wellbore casing at a first end and releasably secured to the deflector shoe at a second end.

6. The apparatus of claim 5, wherein the deflector shoe is releasably secured to a working string at a second end.

7. The apparatus of claim 5, wherein said indexing tool is releasably secured to the main wellbore casing via a tubing anchor.

8. The apparatus of claim 4, wherein said fixed member comprises an inner member and said moveable member comprises an outer member configured to encircle said inner member.

9. The apparatus of claim 8, wherein said inner member and said outer member are configured to fastenably rotate about one another during operation of said indexing tool.

10. The apparatus of claim 9, wherein said outer member is configured to fastenably rotate about a fixed inner member.

11. The apparatus of claim 9, wherein said inner member is configured to fastenably rotate within a fixed outer member.

12. The apparatus of claim 8, wherein said inner member comprises at least one slot that runs along the outer periphery of said inner member.

13. The apparatus of claim 12, wherein said slot comprises one or more landings.

14. The apparatus of claim 12, wherein said slot comprises a predetermined length including a first edge and a second edge.

15. The apparatus of claim 14, wherein said outer member comprises at least one pin extending out from the inside wall of said outer member.

16. The apparatus of claim 15, wherein said pin is configured to mate with said slot.

17. The apparatus of claim 16, wherein said slot is configured to guide the pin for travel a distance less than 360° about the periphery of said inner member.

18. The apparatus of claim 16, wherein said slot is configured to guide the pin for travel more than one revolution about said inner member.

19. The apparatus of claim 16, wherein said slot is configured to guide the pin for travel a distance greater than 90° about the periphery of said inner member.

20. The apparatus of claim 19, wherein said slot is configured to guide the pin for travel a distance at least 360° along said slot about said inner member.

21. The apparatus of claim 12, wherein said slot comprises a seamless configuration.

22. The apparatus of claim 21, wherein said outer member comprises at least one pin extending out from the inside wall of said outer member.

23. The apparatus of claim 22, wherein said pin is configured to mate with said slot.

24. The apparatus of claim 12, wherein said slot comprises one or more profiles, each profile further comprising a landing.

25. The apparatus of claim 24, wherein said slot comprises a helical type pattern along said inner member.

26. The apparatus of claim 24, wherein said profiles are repeatable profiles.

27. The apparatus of claim 24, wherein said profiles are non-repeatable profiles.

28. The apparatus of claim 24, wherein said profiles are a combination of repeatable and non-repeatable profiles.

29. The apparatus of claim 24, wherein said profiles are comprised of J-slot profiles.

30. The apparatus of claim 24, wherein each profile landing correlates to a separate azimuthal setting of the deflector shoe for installing substantially perpendicular boreholes into the formation surrounding the main wellbore casing.

31. The apparatus of claim 24, wherein said outer member comprises at least one pin extending out from the inside wall of said outer member.

32. The apparatus of claim 31, wherein said profile landing is configured to catch and set said pin in a locked position.

33. The apparatus of claim 32, wherein said locked position of said pin is configured to set said deflector shoe in a fixed position for orienting said borehole forming member along one or more settings about the central axis of the indexing tool for installing substantially perpendicular boreholes into the formation surrounding the main wellbore.

34. The apparatus of claim 12, wherein said outer member comprises at least one pin extending out from the inside wall of said outer member.

35. The apparatus of claim 34, wherein said pin is configured to mate with said slot.

36. The apparatus of claim 4, wherein said opening is configured to act as a guide path for said borehole forming member.

37. The apparatus of claim 4, wherein said opening comprises an inlet and an outlet.

38. The apparatus of claim 37, wherein said opening comprises a bend wherein the inlet and outlet of said opening are from slightly greater than 0° up to about 90° to each other.

39. The apparatus of claim 38, wherein said opening comprises a bend wherein the inlet and outlet of said opening are about 90° to each other.

40. The apparatus of claim 4 wherein said indexing tool includes a tubing anchor for releasably securing the indexing tool in a predetermined location within the main wellbore casing and is connected to the fixed member.

41. The apparatus of claim 40 wherein said indexing tool is moved between the first and second azimuthal settings without releasing the tubing anchor.

42. The apparatus of claim 4 wherein the diameter of each substantially perpendicular borehole is relatively small compared with the diameter of the main wellbore casing.

43. The apparatus of claim 42 wherein the diameter of each substantially perpendicular borehole is in the range of 0.5-1.5 inches (1.27-3.75 cm).

44. The apparatus of claim 4 wherein said first and second substantially perpendicular boreholes free from overlapping portions.

45. The apparatus of claim 4 wherein said first and second azimuthal settings are on a common transverse plane along the longitudinal axis of the main wellbore casing.

46. The apparatus of claim 4 wherein said first and second azimuthal settings are on different transverse planes along the longitudinal axis of the main wellbore casing.

* * * * *